US005218901A

United States Patent [19]

Imanishi

[11] Patent Number: 5,218,901

[45] Date of Patent: Jun. 15, 1993

[54] MECHANISM FOR OBTAINING PRECISE REGISTRATION BETWEEN TOP AND BOTTOM DIES IN A PRESS

[75] Inventor: Shozo Imanishi, Sagamihara, Japan

[73] Assignee: Aida Engineering, Ltd., Kanagawa, Japan

[21] Appl. No.: 749,456

[22] Filed: Aug. 26, 1991

[30] Foreign Application Priority Data

Aug. 30, 1990 [JP] Japan ..... 2-230385
Sep. 13, 1990 [JP] Japan ..... 2-243380

[51] Int. Cl.[5] ..... B30B 5/14; B30B 1/06

[52] U.S. Cl. ..... 100/53; 72/448; 72/452; 100/214; 100/282; 100/918; 100/229 R

[58] Field of Search ..... 100/43, 46, 48, 53, 100/214, 282, 918, 258 R, 258 A, 229 R; 72/446–448, 452, 462, 481; 425/451, 451.9, 589

[56] References Cited

U.S. PATENT DOCUMENTS 2,249,149 7/1941 MacMillin ..... 100/282 X
2,784,665 3/1957 Georgeff ..... 100/282 X
2,988,234 6/1961 Barothy et al. ..... 100/229 R X
3,225,686 12/1965 Clements ..... 100/43
3,371,515 3/1968 Munschauer, Jr. ..... 100/229 R X
4,480,538 11/1984 Yoshida ..... 100/43 X

FOREIGN PATENT DOCUMENTS 729584 12/1942 Fed. Rep. of Germany ..... 100/282
1162469 9/1958 France ..... 100/282
718299 2/1980 U.S.S.R. ..... 100/282

*Primary Examiner*—Stephen F. Gerrity
*Attorney, Agent, or Firm*—Lowe, Price, LeBlanc & Becker

[57] ABSTRACT

A mechanism for guiding a slide of a press machine is disclosed. The slide is connected to a crank shaft extending laterally through connecting rods. The press further includes a bolster supporting a bottom die and a top die attached to the slide. An upper guide arrangement is provided between the slide and columns extending upward from a press machine bed for maintaining the slide parallel to the bolster by guiding a vertical stroke of the slide via contact at laterally spaced positions on front and rear sides of the slide. A lower guide is provided for horizontally adjusting the horizontal position of at least one of a first vertical structure including the slide and the press machine bed or of a second vertical structure including the top die and the bottom die to accurately set the dies.

13 Claims, 6 Drawing Sheets

MECHANISM FOR OBTAINING PRECISE REGISTRATION BETWEEN TOP AND BOTTOM DIES IN A PRESS

FIELD OF THE INVENTION

This invention relates to a method of and a mechanism for guiding a vertical stroke of a slide of a press machine.

BACKGROUND ART

Dies used in a press machine include a top die fitted on a slide and a bottom die mounted on a bolster, between which a material may be pressed by a vertical stroke of the slide.

The vertical stroke of the slide is generally controlled with a slide guide such as depicted in FIGS. 6 and 7. Therein, a slide guide 61 (a plain-type guide) has sliding guide members between columns 62 and a slide 63, or a needle-roller type guide having needle roller 5 between the columns 62 and the slide 63. Slide guide 61 is arranged to guide the slide 63 at both upper and lower plural portions, such as at eight portions thereof. It is known that slide guide 61 is influenced by the dimensional change of the components of the press machine due to temperature changes or changes in the press operation, so that the slide guide 61 must have a minimum clearance.

Another slide guide 64 as shown in FIG. 7 comprises a slide 65 having downwardly extending guide posts 66 and a bed 67 provided with guide sleeves 68 into which the corresponding guide posts 66 may be inserted. There are four sets of guide posts 66 and the guide sleeves 68 with zero clearance. To allow the guiding operation to occur under conditions of dimensional change of the press machine, e.g., components due to temperature change as aforesaid, the diameter of guide post 66 is made short so as to decrease its rigidity and permit deflection.

The function of the slide guide where high precision pressing is necessary is to obtain accurate die registration. Another function of the slide guide is to keep the slide parallel to the bolster whenever the slide interacts with an eccentric upward load through the press operation. Therefore, the conventional slide guide 61 as shown in FIG. 6 may be expected to have enough strength to achieve precise pressing since the columns 62 have great rigidity even when the slide 63 interacts with an eccentric upward load during a press operation. However, since slide guide 61 has clearance, as aforesaid, the slide is likely to shift toward one side while pressing. Under such conditions, if the vertical stroke of the slide 63 is repeated or the top die does not coincide with the bottom die, the desirable precise press operation may not occur and the life expectancy of the dies may be shortened.

Since the slide guides 64 in FIG. 7 do not have clearance, precision work with the dies may be done reliably. However, because of the shortened diameter of the guide posts 66 as explained above, if the slide 65 interacts with an eccentric upward load during a press operation, the slide guide 64 may not work as well as expected.

The slide guide should be able to set the dies precisely as desired and also have enough rigidity under an eccentric load to continuously maintain the slide parallel to the bolster. However, conventional slide guides do not satisfy such conditions as described.

An object of the present invention is to obtain a high accuracy of setting of the dies and to have a slide guide with sufficient rigidity against an eccentric load so as to maintain the slide parallel to the bolster so that high accuracy of pressing materials in a press machine may be attained.

SUMMARY OF THE INVENTION

A mechanism for guiding a slide of a press machine is disclosed. The slide is connected to a crank shaft extending laterally through connecting rods. The press further includes a bolster supporting a bottom die and a top die attached to the slide. An upper guide arrangement is provided between the slide and columns extending upward from a press machine bed for maintaining the slide parallel to the bolster by guiding a vertical stroke of the slide via contact at laterally spaced positions on front and on rear sides of the slide. A lower guide is provided for horizontally adjusting the horizontal position of at least one of a first vertical structure including the slide and the press machine bed or of a second vertical structure including the top die and the bottom die to accurately set the dies.

The lower guide preferably includes a plurality of guide posts on at least one of the slide and bed or top and bottom dies of at least one of the first or second vertical structures, respectively, in corresponding guide sleeves on at least one of the other of the slide and bed, or the other of the top and bottom dies, respectively, so that each guide post is inserted into the corresponding guide sleeve.

The guide post of the lower guide may be inserted into the guide sleeve with or without a clearance.

Each guide sleeve preferably includes therewithin a guide bush defining an oil chamber which is connected with a pressure oil supply so that feeding of an oil into the oil chamber when the top die is attached to the slide causes the guide bush to be deformed inwardly to provide a zero clearance between the guide bush and the guide post.

The lower guide further comprises plural cylinders each of which is disposed around at least one of the slide or the top die and is mounted to a stationary member so that the horizontal position of said at least one of the slide or the top die is determined by the adjustment of the cylinders. Preferably, a pressure area of a piston of one cylinder is of different size from a pressure area of a piston of the other cylinder in horizontal opposition to said one cylinder.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF THE PREFERRED EMBODIMENT(S)

Figure 1:
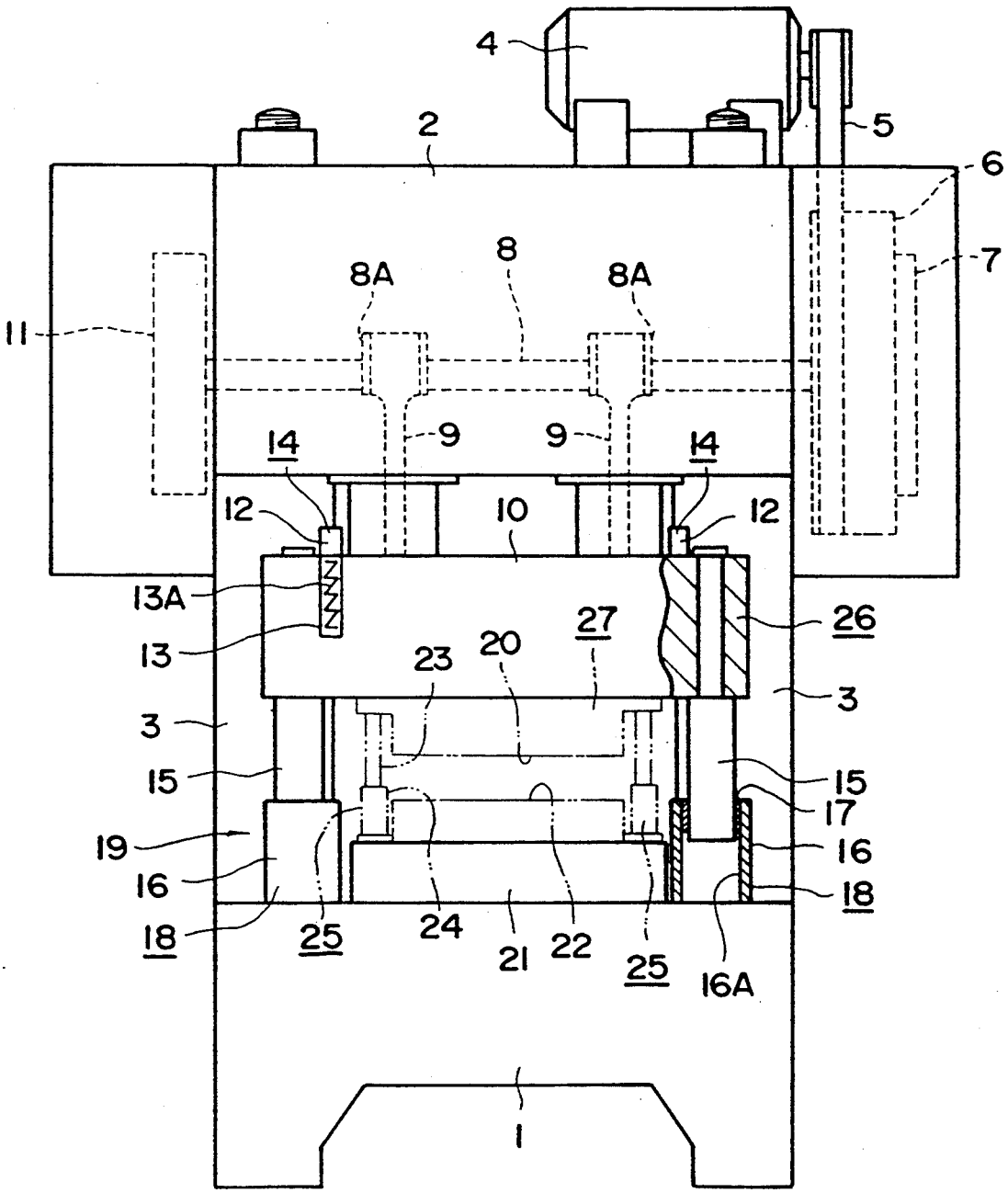
FIG. 1 is a partial sectional front view of the press machine according to the present invention.
Figure 2:
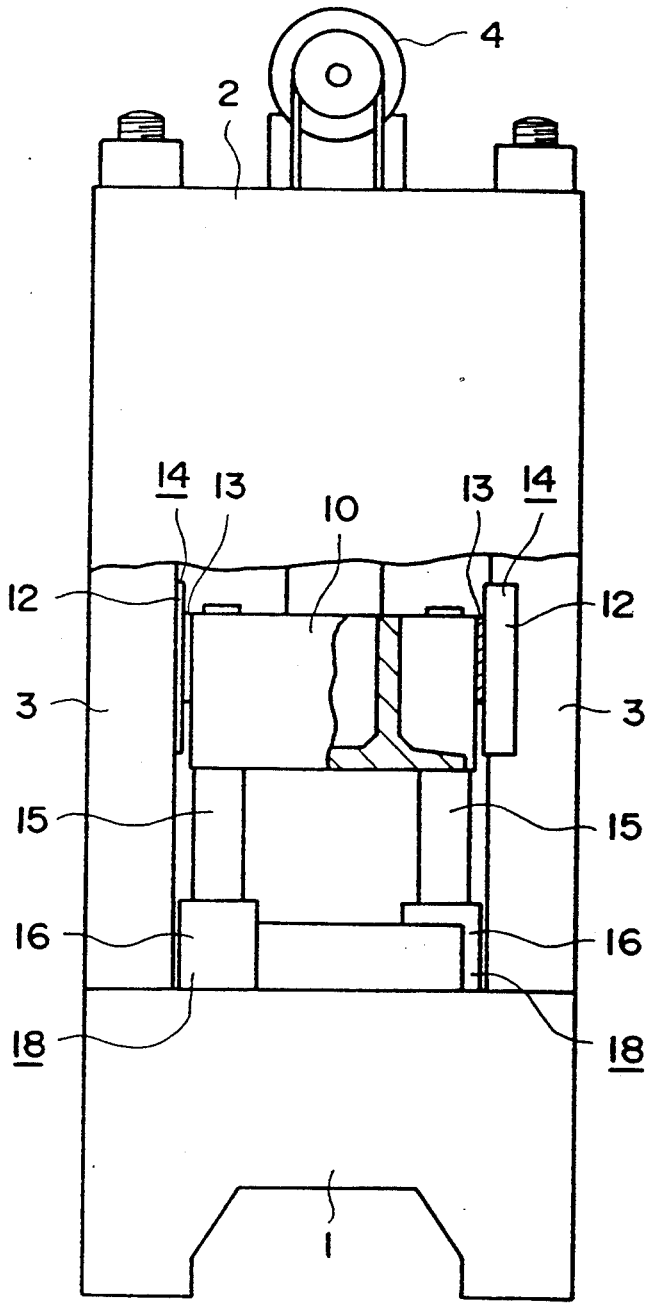
FIG. 2 is a partial sectional side view of the press machine shown in FIG. 1.

In FIG. 1, a bed 1 and a crown 2 are connected through four columns 3. A drive output produced by a motor 4 mounted on the crown 2 is transferred to a flywheel 6 through a belt 5. The revolution of the flywheel 6 is further transferred through a clutch 7 to a crank shaft 8 extending laterally inside of the crown 2. Eccentric portions 8A of the crank shaft 8 are connected to a slide 10 through connecting rods 9. Accordingly, the slide 10 is moved vertically as a result of rotation of the crank shaft 8. At the opposite side of the clutch 7 and the another end of the crank shaft 8, a brake 11 is provided.

The columns 3 have slide guide members 12 which face lateral portions both on front and on rear side surfaces of the slide 10. Slide 10 has guide members 13 with a lubricating slot in positions corresponding to the guide members 12. These guide members 12 and 13 define an upper guide device 14 of the slide 10. The upper guide device 14 is a plane-type guide. The upper guide device 14 therefore comprises four elements at lateral positions both on front and on rear sides of the slide. The guide members 12 and 13 are positioned with a clearance therebetween.

Each corner of the slide 10 has a guide post 15 extending downwardly, and guide sleeves 16 corresponding to four guide posts 15 are provided on bed 1. Each guide sleeve has a guide bush 17 therewithin, so that the guide post fits into the guide bush. Guide posts 15 and corresponding guide sleeves 16 define a lower guide device 18. The lower guide device 18 therefore comprises four elements with no clearance between the guide post 15 and the guide sleeve 16. Since the diameter of the guide post 15 is relatively small, it is capable of deflecting movement if slide 10 interacts with a predetermined eccentric load. Accordingly, the lower guide device 18 does not have much rigidity.

The lower guide device 18 may alternatively be of such a arrangement that a plain guide bush (not shown) is fitted onto an inner surface 16A of the guide sleeve 16 and the guide post 15 is then inserted thereinto.

The slide 10 may be guided by the upper guide device 14 and the lower guide device 18. These guide devices 14 and 18 define a slide guide 19.

A top die 20 is attached to the slide 10 and a bottom die is mounted on the bolster 21. The top die 20 is provided with guide posts 23 and the bottom die 22 is provided with guide sleeves 24 so that the guide posts 23 may be inserted thereinto. When the slide 10 is under its vertical stroke, the top die 20 is guided by a die guide 25 comprised of these guide posts 23 and guide sleeves 24.

When the dies 20 and 22 are mounted to the slide 10 and the bolster 21, respectively, the position of the slide 10 is determined at the time when the slide 10 reaches the lower end level which is above the bottom die on the bolster 21. Hence, the top die 20 and the bottom die 22 are set to the slide 10 and the bolster 21, respectively, with bolts and clamps with great accuracy.

As mentioned above, the high accuracy of setting the top die 20 and the bottom die 22 may be achieved by the lower guide device 18 having guide posts 15 with no clearance.

Figure 3:
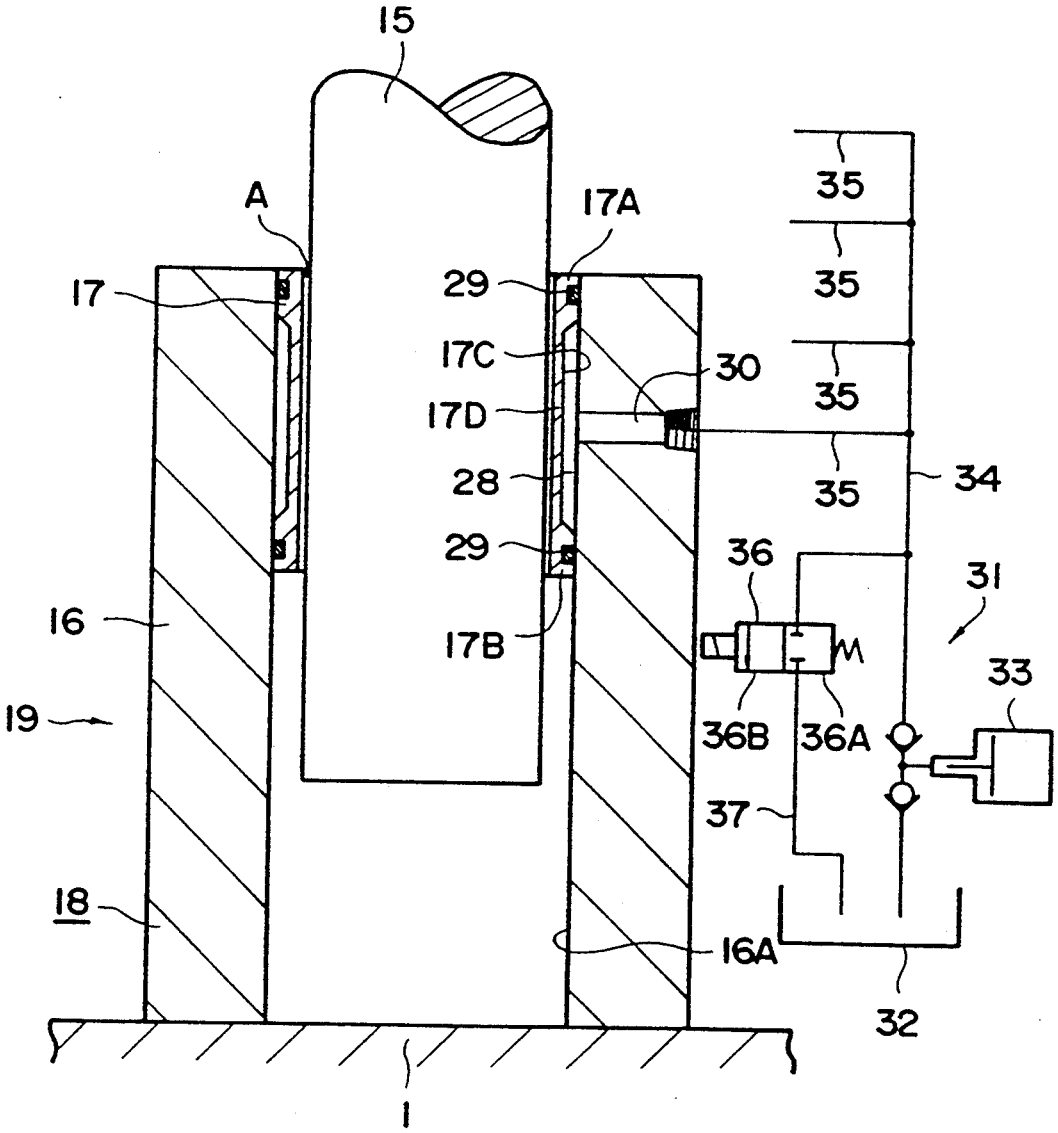
FIG. 3 is a front view of an arrangement for determining the horizontal position of the slide.

FIG. 3 is a detailed view of the lower guide device 18. It is to be noted that the die guide 25 may employ the same arrangement. The lower guide device 18 has a guide bush 17 which is coupled into the guide sleeve 16 to fit on the inner surface 16A. The guide bush 17 allows the guide post 15 to be inserted thereinto with a clearance denoted by A. The upper guide device 14 also involves such a clearance between the guide members 12 and 13.

The slide 10 having guide posts 15 and the bed 1 having guide sleeves 16 constitute a first vertical structure 26. The top die 20 having guide posts 23 and the bottom die having guide sleeves 24 constitute a second vertical structure 27.

The guide bush 17 as depicted in FIG. 3 is made from a deformable resin or metal. Both upper and lower portions 17A and 17B of the guide bush 17 are thick and the middle elongate portion 17D is thin in relation thereto so as to define an outer surface 17C being deformed inwardly. The outer surface 17C forms an oil chamber 28 with inner surface 16A of the guide sleeve 16. The oil chamber 28 is sealed by seal members 29 within the thick portions 17A and 17B.

The oil chamber 28 is formed entirely around the guide bush 17 and is connected to a pressure oil supply device 31 through an oil passage 30 within the guide sleeve 16.

The pressure oil supply device 31 comprises a pressure oil supply piping 34 for feeding an oil in an oil tank 32 with a pump 33, through branch piping 35 provided from the pressure oil supply piping 34 to the oil chamber 28 through the oil passage 30. An oil return piping 37 leads back from the pressure oil supply piping 34 to the oil tank 32 and includes a switch valve 36 for purposes described hereinafter. Branch piping 35 is provided for each guide sleeve 16.

The operation of the present press machine having the lower guide device with the clearance is now described.

In order to set both the top die 20 and the bottom die 22 to the slide 10 and the bolster 21, respectively, first, both dies should be kept in a condition that the top die 20 is placed on the bottom die 22 on the bolster 21. The slide 10 is then lowered down to its lower end level. The switch valve 36 is shifted to a position 36A allowing the oil from oil tank 32 to be transferred to the oil chamber 28 with the pump 33. The oil fed into the oil chamber 28 works to deform the thin portion 17D of the guide bush 18 radially inwardly, so that the clearance A between the guide bush 17 and the guide post 15 disappears to thereby enable the thin portion 17D to contact the outer surface of the guide post 15.

The disappearance of clearance A may take place at each side of the four corners of the slide 10, or between the guide posts 15 and the guide sleeves 16. Accordingly, the slide 10, which was previously free to move horizontally corresponding to the clearance of the upper guide device 14 and of the lower guide device 18, is now maintained at a certain position.

Subsequently, the bottom die 22 is mounted on the bolster 21 by bolts or clamps and the top die 20 is also set to the slide 10. In this State, since the slide 10 is kept at a certain position as described, the slide 10 is not moved horizontally during fitting operation of the top die 20 to the slide 10 but is kept at a desirable position with reference to the bolster 21.

After setting the dies 20,22, the switch valve 36 is shifted to a position 36B and the oil in the oil chamber 28 is returned to the oil tank 32. The shape of the thin portion 17D of the guide bush 17 is restored to once again establish clearance A.

When the vertical stroke of the slide 10 is commenced for press operation, the positional relationship between the slide 10 or the top die 20 and the bolster 21 or the bottom die 22 is made precise since the slide 10 is horizontally maintained at a certain position and the top die 20 is vertically moved with reference to the bottom die 22 by the die guide 25. Hence, the material is precisely pressed and the life of the male top die 20 and the female bottom die 22 is long due to correct registration with each other through press operation.

In the above embodiment of the first vertical structure 26, the guide post 15 for the slide 10 and the guide sleeve 16 for the bed 1 may be interchanged.

Figure 4:
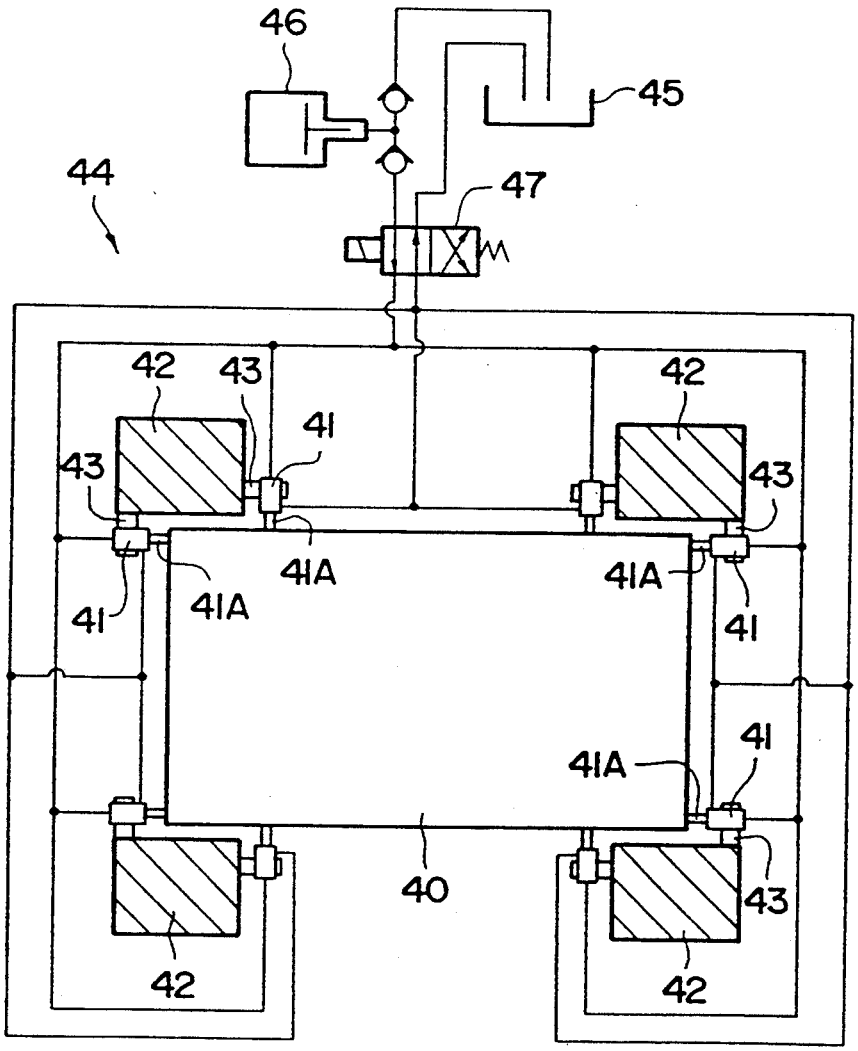
FIGS. 4 and 5 are sectional plan views of other arrangements of the present invention.

Another embodiment of the lower guide device is depicted in FIG. 4. Therein, a slide 40 is moved vertically in the same manner as the above-mentioned slide guide. A top die is also moved with reference to the corresponding bottom die in the same manner as that of the above-mentioned die guide.

The slide 40 has a plurality of horizontal cylinders 41 such that a piston rod 41A of each cylinder 41 extends toward the slide 40. These cylinders 41 are secured to the columns 42 by brackets 43. Each cylinder 41 is connected with a cylinder drive device 44 which comprises a pump 46 for feeding an oil kept in an oil tank 45 and a switch valve 47 for lengthening and shortening the cylinder 41 with the oil fed from the oil tank 45. The horizontal positioning of the slide 40 may be accomplished by the lengthening of the cylinder 41 such that the projected piston rod 41A contacts the slide 40.

In this embodiment, the horizontal positioning of the slide 40 is performed by the lengthening of the cylinder 41 at the time the top and bottom dies are mounted to the slide and the bolster, respectively. Since the slide 40 does not move horizontally during fitting of the top die to the slide 40 with brackets, the clearance recognized in the slide guides is not a moving area for the slide 40. Hence, after shortening the cylinders 41, when the slide 40 is operated to perform a vertical stroke for pressing, the positional relationship between the slide or the top die and the bolster or the bottom die is maintained to execute a precise pressing.

Figure 5:
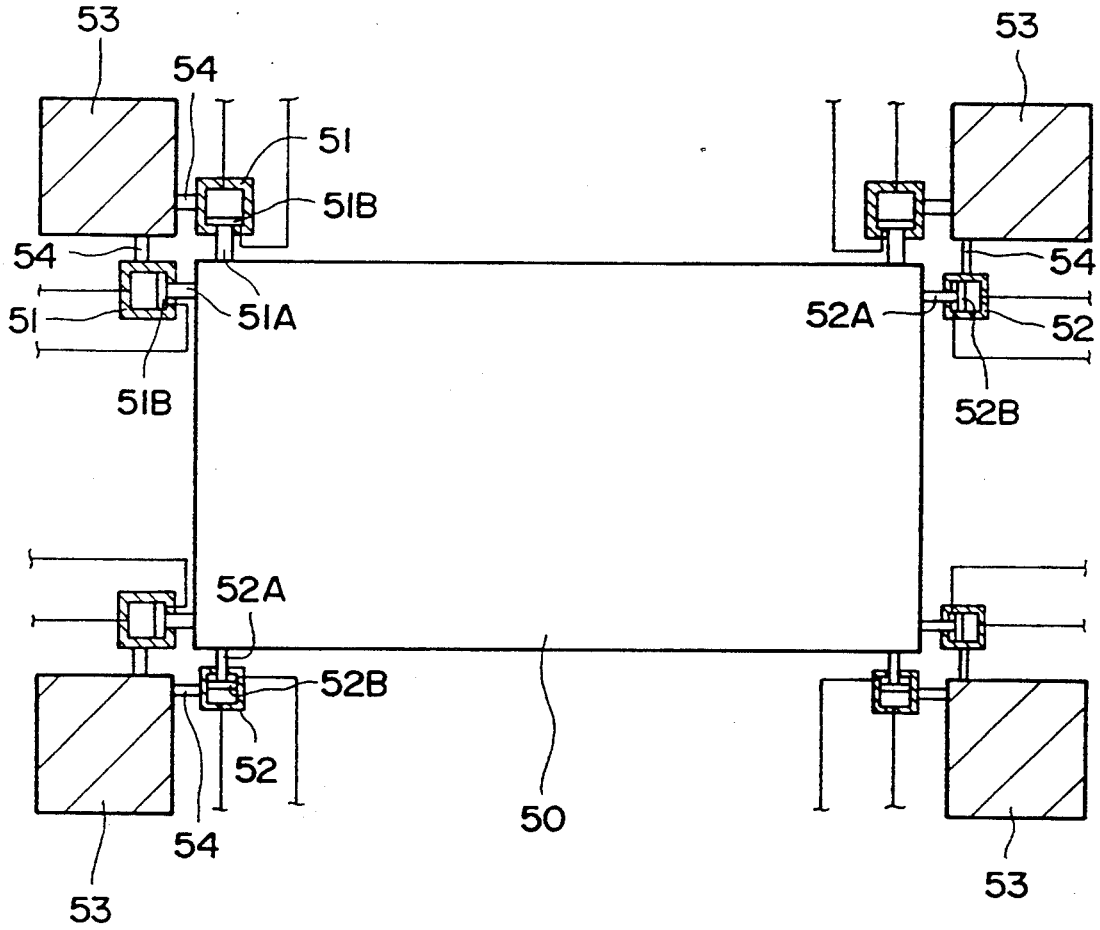
Figure 6:
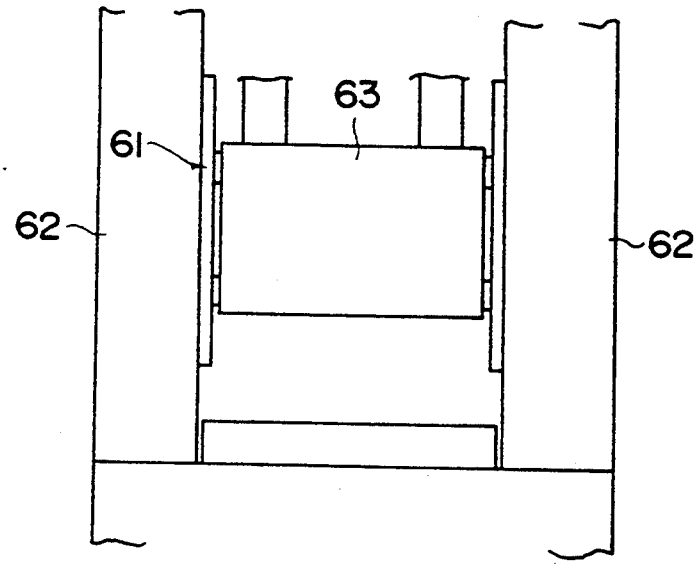
FIG. 6 PRIOR ART
FIGS. 6 and 7 are views of conventional slide guides.
Figure 7:
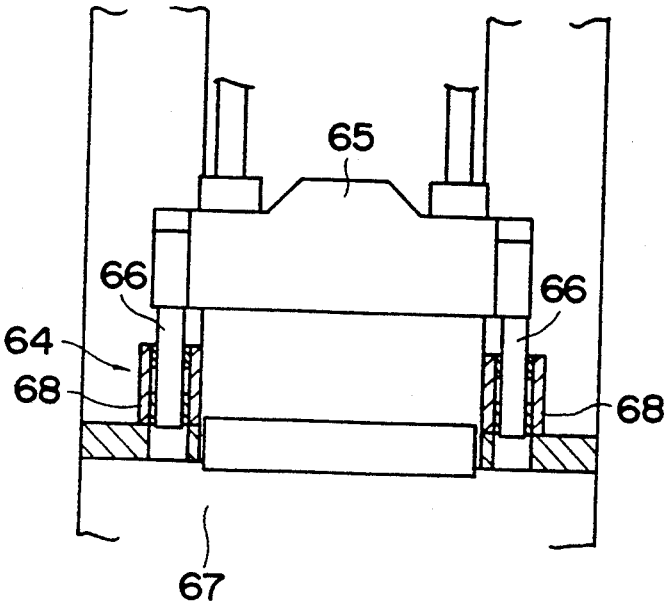
FIG. 7 PRIOR ART

Another embodiment of the lower guide device is further depicted in FIG. 5. A slide 50 is vertically moved in the same manner as that of the above-mentioned slide guide. A top die is also moved with reference to the corresponding bottom die in the same manner as that of the above-mentioned die guide. The slide 50 has two kinds of cylinders, one of which is denoted by 51 and has a piston 51B and the other of which is denoted by 52 and has a piston 52B; therein, the pressurized areas of the pistons 51B,52B are different from each other. The cylinders 51 and 52 are disposed horizontally so that piston rods 51A and 52A project toward the slide 50. These cylinders 51 and 52 are secured to the columns 53 with brackets 54. The cylinders 51, each of which has the piston 51B with a large pressurized area, are provided at either front or rear portions and either left or right portions of the slide 50. The Cylinders 52, each of which has the piston 52B with a small pressurized area, are provided at the horizontally opposite sides of the cylinders 51.

In this embodiment, when the same pressurized oil is fed into both the cylinders 51 and 52 at the same time to extend the piston rods 51A and 52A, the projection of the piston rod 52A is restricted by that of the piston rod 51A due to the gap of the pressurized area, so that the slide 50 is horizontally positioned in an accurate manner.

In each embodiment, the slide 10, 40 or 50 as a half-structure of the first vertical structure 26 is horizontally positioned, but it is also possible to employ such a structure for the top die 20 as a half-structure of the second vertical structure 27.

Particularly, the vertical movement of the top die 20 is guided by the die guide 25 consisting of the guide post 23 and the guide sleeve 24. It may be acknowledged that this arrangement is similar to that for the slide 10 and the bed 1 as the first vertical structure 26, so that the top die 20 may be horizontally positioned by employing a similar arrangement shown in FIG. 3 for the die guide 25. Otherwise, the horizontal positioning of the top die 20 may be done by the similar arrangements shown by FIGS. 4 and 5.

Accordingly, after determining the horizontal position of the top die, the top die should be attached to the slide by brackets. In this process, the slide is likely to be moved to one side corresponding to the clearance of the slide guide, but the positional accuracy of the top die with reference to the bottom die is kept fine to thereby perform a fine pressing operation.

In the foregoing, the horizontal positioning of the slide and of the top die are alternative, but it is also recommendable to do both.

The arrangement of the slide guide is not necessary to be limited to the embodiments mentioned above, whereby this invention may be applied to any type of press machines having a slide guide.

The upper guide device 14 is not limited to be of the plain-type guide with the guide members 12 and 13, but a needle-roller type guide using needle rollers between the columns and the slide.

According to the present invention, when the top die is attached to the slide, the horizontal position of either the slide or the top die is firstly determined. The top die is subsequently set to thereby keep precise positional relationship with reference to the bottom die, so that the press operation may be done accurately and the shortening of the life of dies may be prevented.

What is claimed is:

1. A mechanism for guiding a slide of a press machine, said slide having a front and rear sides and said slide being connected to a crank shaft extending laterally through connecting rods, said press further including a press machine bed having columns extending upward from said press machine bed toward said slide, a bolster supporting a bottom die and a top die attached to the slide, said mechanism comprising:

an upper guide arrangement provided between the slide and columns for guiding a vertical stroke of the slide via contact at laterally spaced positions on said front and on said rear sides of the slide; and a lower adjustable guide means for horizontally adjusting the relative horizontal position of at least one of a first vertical structure including the slide and the press machine bed and of a second vertical structure including the top die and the bottom die, wherein the relative horizontal position of the first vertical structure is adjusted by relative horizontal adjustment between said slide and said press machine bed, and wherein the relative horizontal position of the second vertical structure is adjusted by relative horizontal adjustment between said top die and said bottom die, whereby the dies are accurately set relative to one another.

2. A mechanism for guiding a slide of a press machine according to claim 1, said lower guide means includes a plurality of guide posts on at least one of the slide and bed of the first vertical structure and corresponding guide sleeves on the other of the slide and bed, so that each guide post is inserted into the corresponding guide sleeve.

3. A mechanism for guiding a slide of a press machine according to claim 2, wherein the guide post is inserted into the guide sleeve without a clearance therebetween.

4. A mechanism for guiding a slide of a press machine according to claim 2, wherein the guide post is inserted into the guide sleeve with a clearance therebetween.

5. A mechanism for guiding a slide of a press machine according to claim 4, wherein each guide sleeve includes therewithin a flexible guide bush which receives the inserted guide post, said guide bush defining an oil chamber with said guide sleeve, and said oil chamber is connected with a pressurized oil supply, whereby feeding of pressurized oil into the oil chamber causes the flexible guide bush to be deformed towards said inserted guide post to provide a zero clearance between the guide bush and the guide post.

6. A mechanism for guiding a slide of a press machine according to claim 1, said press further including a plurality of stationary members and said lower guide means further comprising a plurality of fluid cylinders each of which is positioned to adjust at least one of the slide and the top die and is mounted to one of said plurality of stationary members so that the horizontal position of said at least one of the slide and the top die is determined by the adjustment of the fluid cylinders.

7. A mechanism for guiding a slide of a press machine according to claim 6, wherein each of said plurality of fluid cylinders includes a piston with a corresponding pressurized area, a first of said plurality of fluid cylinders is in horizontal opposition to a second of said plurality of fluid cylinders, and said pressurized area of said first piston is of different size from said pressurized area of said second piston.

8. A mechanism for guiding a slide of a press machine according to claim 1, wherein said upper guide arrangement is a plane-type guide having a clearance between said slide and said columns.

9. A mechanism for guiding a slide of a press machine according to claim 1, wherein said upper guide arrangement is a needle-roller type guide having a clearance between said slide and said columns.

10. A mechanism for guiding a slide of a press machine according to claim 1, said lower guide means includes a plurality of guide posts on at least one of the top and bottom dies of the second vertical structure and corresponding guide sleeves on the other of the top and bottom dies so that each guide post is inserted into the corresponding guide sleeve.

11. A mechanism for guiding a slide of a press machine according to claim 10, wherein the guide post is inserted into the guide sleeve without a clearance therebetween.

12. A mechanism for guiding a slide of a press machine according to claim 10, wherein the guide post is inserted into the guide sleeve with a clearance therebetween.

13. A mechanism for guiding a slide of a press machine according to claim 12, wherein each guide sleeve includes therewithin a flexible guide bush which receives the inserted guide post, said guide bush defining an oil chamber with said guide sleeve, said oil chamber is connected with a pressurized oil supply, whereby feeding of a pressurized oil into the oil chamber causes the flexible guide bush to be deformed towards said guide post to provide a zero clearance between the guide bush and the guide post.

* * * * *